US010024563B2

(12) United States Patent
Nakamoto et al.

(10) Patent No.: US 10,024,563 B2
(45) Date of Patent: Jul. 17, 2018

(54) INDOOR UNIT OF AIR-CONDITIONING APPARATUS AND AIR-CONDITIONING APPARATUS

(71) Applicant: Mitsubishi Electric Corporation, Tokyo (JP)

(72) Inventors: Yukio Nakamoto, Tokyo (JP); Takashi Matsumoto, Tokyo (JP); Hiroshi Hirosaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 146 days.

(21) Appl. No.: 14/712,978

(22) Filed: May 15, 2015

(65) Prior Publication Data

US 2015/0377503 A1 Dec. 31, 2015

(30) Foreign Application Priority Data

Jun. 25, 2014 (JP) ..... 2014-130666

(51) Int. Cl.
*F24F 1/02* (2011.01)
*F24F 11/00* (2018.01)
(Continued)

(52) U.S. Cl.
CPC ..... *F24F 11/001* (2013.01); *F24F 1/0007* (2013.01); *F24F 1/02* (2013.01);
(Continued)

(58) Field of Classification Search
CPC ..... F24F 11/0034; F24F 11/0012; F24F 11/0078; F25D 17/045; F25D 17/065; F25D 29/00
(Continued)

(56) References Cited

U.S. PATENT DOCUMENTS 5,251,814 A * 10/1993 Warashina ..... F24F 1/0007 236/49.3
5,505,378 A * 4/1996 Park ..... G05D 27/02 236/49.3
(Continued)

FOREIGN PATENT DOCUMENTS

CN 101672498 A 3/2010
CN 101963384 A 2/2011
(Continued)

OTHER PUBLICATIONS

JP 2014164216 A Machine Translation English—Retrieved Apr. 2017.*
(Continued)

*Primary Examiner* — Len Tran
*Assistant Examiner* — Jenna M Hopkins
(74) *Attorney, Agent, or Firm* — Posz Law Group, PLC

(57) ABSTRACT

An indoor unit of an air-conditioning apparatus including a body placed on a wall surface of a room that is an air-conditioned space, the indoor unit including a temperature sensor disposed at a position projecting from the body, and including a temperature detector that detects a temperature based on heat radiation from a target and a motor that causes the temperature detector to rotate, the position being a place where the temperature sensor is capable of detecting a temperature in all the horizontal directions by rotating the temperature detector.

12 Claims, 16 Drawing Sheets

(51) Int. Cl.

| | |
|---|---|
| ***F24F 1/00*** | (2011.01) |
| ***F24F 13/10*** | (2006.01) |
| ***F24F 11/30*** | (2018.01) |
| ***F24F 11/72*** | (2018.01) |
| *F24F 11/34* | (2018.01) |
| *F24F 11/79* | (2018.01) |
| *F25D 17/04* | (2006.01) |
| *F25D 17/06* | (2006.01) |
| *F25D 29/00* | (2006.01) |
| *F24F 110/00* | (2018.01) |
| *F24F 110/10* | (2018.01) |
| *F24F 110/20* | (2018.01) |
| *F24F 120/14* | (2018.01) |

(52) U.S. Cl.
CPC ..... *F24F 11/30* (2018.01); *F24F 11/72* (2018.01); *F24F 13/10* (2013.01); *F24F 11/34* (2018.01); *F24F 11/79* (2018.01); *F24F 2001/0048* (2013.01); *F24F 2001/0062* (2013.01); *F24F 2110/00* (2018.01); *F24F 2110/10* (2018.01); *F24F 2110/20* (2018.01); *F24F 2120/14* (2018.01); *F25B 2313/031* (2013.01); *F25B 2313/0314* (2013.01); *F25D 17/045* (2013.01); *F25D 17/065* (2013.01); *F25D 29/00* (2013.01); *F25D 2317/0682* (2013.01); *F25D 2400/04* (2013.01)

(58) Field of Classification Search
USPC ..... 62/186
See application file for complete search history.

(56) References Cited

U.S. PATENT DOCUMENTS

| | | | | | |
|---|---|---|---|---|---|
| 5,815,078 | A * | 9/1998 | Mun | F24F 11/79 | 340/573.1 |
| 5,924,923 | A * | 7/1999 | Chiguchi | F24F 1/0011 | 165/122 |
| 6,715,689 | B1 * | 4/2004 | Lee | F24F 11/0034 | 236/49.3 |
| 7,881,827 | B2 * | 2/2011 | Park | F24F 11/0034 | 236/51 |
| 8,103,384 | B2 * | 1/2012 | Matsumoto | F24F 11/0012 | 454/256 |
| 8,364,317 | B2 * | 1/2013 | Park | F24F 11/0034 | 250/342 |
| 2009/0140059 | A1 * | 6/2009 | Barton | F24F 11/0012 | 236/51 |
| 2010/0100255 | A1 * | 4/2010 | Chao | F24F 11/0034 | 700/300 |
| 2011/0319009 | A1 | 12/2011 | Nam | | |
| 2012/0012297 | A1 * | 1/2012 | Nakagawa | F24F 11/0012 | 165/247 |
| 2012/0174608 | A1 * | 7/2012 | Kumamoto | F24F 11/0078 | 62/186 |
| 2015/0233598 | A1 * | 8/2015 | Shikii | F24F 11/0034 | 165/244 |

FOREIGN PATENT DOCUMENTS

| | | | | | |
|---|---|---|---|---|---|
| CN | 102301188 | A | | 12/2011 | |
| CN | 204704987 | A | | 10/2015 | |
| EP | 2184553 | A1 | * | 5/2010 | F24F 1/0007 |
| EP | 2 194 330 | A2 | | 6/2010 | |
| EP | 2 292 986 | A2 | | 3/2011 | |
| EP | 2 395 291 | A2 | | 12/2011 | |
| EP | 2639517 | A2 | * | 9/2013 | F24F 1/00 |
| GB | 2177500 | A | * | 1/1987 | F24F 11/0009 |
| GB | 2513694 | A1 | * | 5/2014 | |
| GB | 2513694 | A | * | 11/2014 | F24F 11/0034 |
| JP | H05-157320 | A | | 6/1993 | |
| JP | H06-159757 | A | | 6/1994 | |
| JP | 07203283 | A | * | 8/1995 | |
| JP | 2001-355898 | A | | 12/2001 | |
| JP | 2003185227 | A | * | 7/2003 | F24F 1/0011 |
| JP | 2005-016885 | A | | 1/2005 | |
| JP | 2008-164179 | A | | 7/2008 | |
| JP | 2010091158 | A1 | * | 4/2010 | |
| JP | 2010-159887 | A | | 7/2010 | |
| JP | 2010266188 | A | * | 11/2010 | F24F 11/0034 |
| JP | 2010-286208 | A | | 12/2010 | |
| JP | 2011-027305 | A | | 2/2011 | |
| JP | 2011-179732 | A | | 9/2011 | |
| JP | 2012-042183 | A | | 3/2012 | |
| JP | 2012042183 | A | * | 3/2012 | |
| JP | 2012-107865 | A | | 6/2012 | |
| JP | 2013-050239 | A | | 3/2013 | |
| JP | 2013-079774 | A | | 5/2013 | |
| JP | 2013-200098 | A | | 10/2013 | |
| JP | 2013-213610 | A | | 10/2013 | |
| JP | 2013-253717 | A | | 12/2013 | |
| JP | 2014164216 | A | * | 9/2014 | G02B 7/1805 |
| JP | 6242300 | B2 | * | 12/2017 | F24F 13/10 |
| KR | 1020030048919 | A | * | 6/2003 | |

OTHER PUBLICATIONS

JP 07203283 A Machine Translation English.*
JP 2012042183 Machine Translation English—Retrieved Apr. 2017.*
JP 201066188 Machine Translation English—Retrieved Apr. 2017.*
JP 2014164214A Machine Translatnion English—Retrieved Apr. 2017.*
JP 07203283A Machine Translation English—Retrieved Apr. 2017.*
Extended European Search Report dated Dec. 11, 2015 issued in corresponding EP patent application No. 15169665.5.
Office Action dated Mar. 28, 2017 in the corresponding Japanese Patent Application No. 2014-130666 (and English translation).
Office Action dated Aug. 2, 2017 issued in corresponding CN patent application No. 201510282168.0 (and English translation).
Communication pursuant to Article 94(3) EPC dated Feb. 9, 2018 issued in corresponding EP patent application No. 15169665.5.

* cited by examiner

INDOOR UNIT OF AIR-CONDITIONING APPARATUS AND AIR-CONDITIONING APPARATUS

TECHNICAL FIELD

The present invention relates to, for example, an indoor unit of an air-conditioning apparatus.

BACKGROUND ART

Some indoor units of air-conditioning apparatuses include motion detectors that detect, for example, the presence of a person in a room. The motion detector is, for example, a temperature sensor (a temperature detector) that detects a temperature due to heat generated from a person. For example, an indoor unit of an air-conditioning apparatus rotates a temperature sensor in order to increase the detection range (see, for example, Patent Literature 1).

CITATION LIST

Patent Literature

[Patent Literature 1] Japanese Unexamined Patent Application Publication No. 2012-42183 (FIG. 2)

SUMMARY OF INVENTION

Technical Problem

A wall-mounted indoor unit of an air-conditioning apparatus, for example, is often placed on a wall (outer wall) separating the building into inside and outside, because of the relationship between components such as an outdoor unit and pipes. In such cases, a temperature sensor such as a motion detector is placed so as to detect the temperature of a target moving in a direction from a wall to the inside of the room. In Patent Literature 1, for example, the temperature sensor is disposed below the front surface of the body.

However, in a season such as winter, for example, the temperature at the outer wall that is in contact with cold outdoor air is the lowest in the room. Thus, in thermal calculation, it is important to detect the temperature of the outer wall. However, since the outer wall is the wall on which the indoor unit is placed, the temperature sensor is not conventionally directed to the outer wall in order to detect the temperature at the outer wall. In addition, in a case where the temperature sensor can detect the temperature only in a narrow range, comfort and energy saving performance, for example, are limited.

It is therefore an object of the present invention to provide, for example, an indoor unit of an air-conditioning apparatus that can detect the temperature in a wider range.

Solution to Problem

To achieve the object, in an indoor unit of an air-conditioning apparatus according to the present invention including the indoor unit having a body placed on a wall surface of a room that is an air-conditioned space, the indoor unit 100 including a temperature sensor disposed at a position projecting from the body, and including a temperature detector that detects a temperature based on heat radiation from a target and a driver that causes the temperature detector to rotate, the position being a place where the temperature sensor is capable of detecting a temperature in all the horizontal directions by rotating the temperature detector.

Advantageous Effects of Invention

The indoor unit of the air-conditioning apparatus of the present invention includes the temperature sensor that can detect a temperature of a target in all the horizontal directions. Thus, the temperature detection range in a room that is an air-conditioned space, for example, can be expanded.

DESCRIPTION OF EMBODIMENTS

Figure 1:
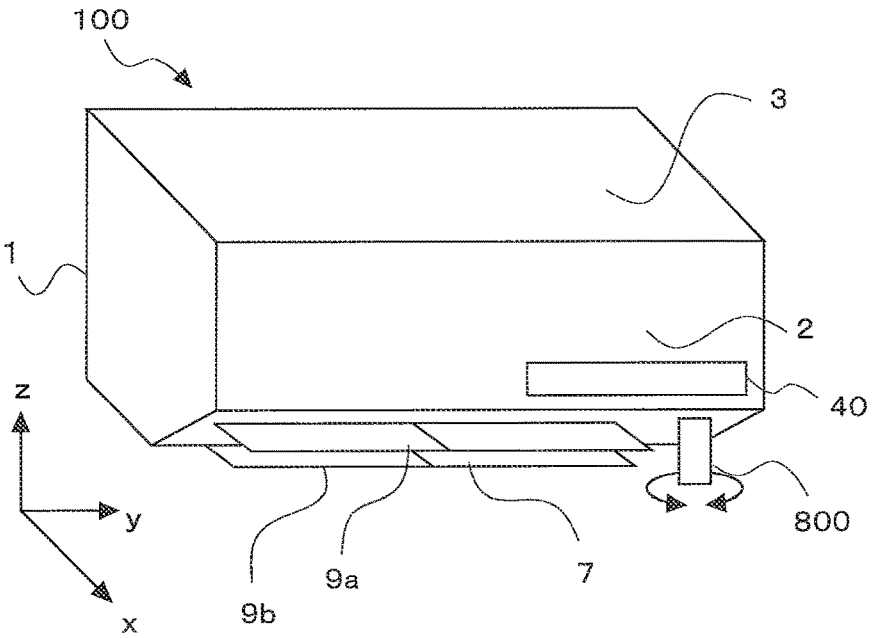
FIG. 1 is a perspective view illustrating a configuration of an indoor unit 100 of an air-conditioning apparatus according to Embodiment 1 of the present invention.

Indoor units of air-conditioning apparatuses (hereinafter referred to as indoor units) according to embodiments of the present invention will be described hereinafter with reference to the drawings. In the drawings including FIG. 1, the same reference characters designate the same or like components, and the same holds for the entire description of the embodiments. The configurations of components in the entire description are merely examples, and the present invention is not limited to these examples. In particular, combinations of components are not limited to those in the embodiments, and components in one embodiment are applicable to another embodiment. Similar devices designated by suffixes, for example, may be collectively referred to without the suffixes when these devices do not need to be individually distinguished or specified. The upper side in the drawings will be referred to as an "upper (side)" and the lower side in the drawings will be referred to as a "lower (side)." The right side when viewed from the indoor unit is defined as "right" and the left side when viewed from the indoor unit is defined as "left." In the drawings, the size relationship among components may differ from those in an actual unit. The levels of, for example, temperature and pressure do not depend on a specific relationship with absolute values, and are relatively defined in consideration of, for example, conditions and operations of a system, a device, and other elements.

Embodiment 1

(Configuration)

FIG. 1 is a perspective view illustrating a configuration of an indoor unit 100 of an air-conditioning apparatus according to Embodiment 1 of the present invention. First, a schematic configuration of the indoor unit 100 of Embodiment 1 will be described. The indoor unit 100 of Embodiment is a wall-mounted indoor unit placed on a wall surface.

Referring to FIG. 1, the indoor unit 100 includes an air inlet 3 at the top of a body 1 and an air outlet 7 at the bottom of the body 1. A front panel 2 covers the front surface of the body 1 such that the body 1 can be freely covered and uncovered. The front panel 2 includes, for example, a notification device 40 that notifies a user of, for example, an operating state with display or the like. The air outlet 7 includes front vertical air deflectors 9*a* and rear vertical air deflectors 9*b* for adjusting the vertical (upward and downward) airflow (air-sending) directions of conditioned air. In Embodiment 1, the indoor unit 100 includes a temperature sensor 800 that is located at the bottom of the body 1 on a side of the air outlet 7 and projects from the body 1. The temperature sensor 800 is an infrared ray sensor (a detector) that detects heat radiated from the surface of a target such as a person or an object while scanning the temperature of the inside of a room that is an air-conditioned space. In FIG. 1, the temperature sensor 800 is located on the left side on the bottom of the body 1 of the indoor unit 100. This location, however, does not limit the type and location, for example, of the temperature sensor of the present invention.

Figure 2:
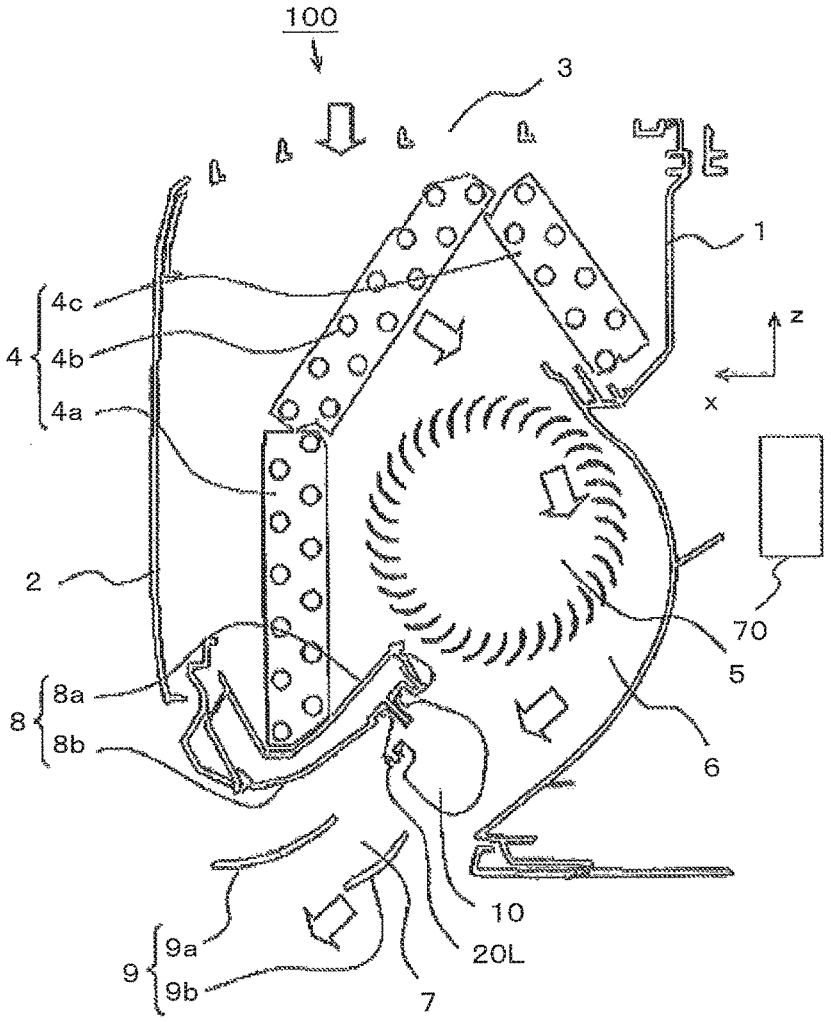
FIG. 2 is a sectional view schematically illustrating an internal configuration of the indoor unit 100 of Embodiment 1 of the present invention.

FIG. 2 is a sectional view schematically illustrating an internal configuration of the indoor unit 100 of Embodiment 1 of the present invention. A fan 5 forms an air passage 6 in which air in the room flows from the air inlet 3 into the body 1, passes through an indoor heat exchanger 4, and is blown (sent) from the air outlet 7. The indoor heat exchanger 4 includes a heat exchanger front portion 4*a* that is substantially parallel to the front panel 2, a heat exchanger upper front portion 4*b* located obliquely above, the front surface of the fan 5, and a heat exchanger upper rear portion 4*c* located close to, and obliquely above the rear surface of the fan 5. The indoor heat exchanger 4 exchanges heat between air caused to flow through the indoor heat exchanger 4 by driving the fan 5 and refrigerant passing through the inside of the indoor heat exchanger 4 so as to cool or heat, for example, the air.

A drain pan 8 is disposed below the heat exchanger front portion 4*a* so as to receive water (drain water) generated from, for example, frost or dew attached to the indoor heat exchanger 4. An upper surface 8*a* of the drain pan 8 forms a drain pan surface that receives drain water in actual application, and a lower surface 8*b* of the drain pan 8 serves as a front surface of the air passage 6.

The controller 70 performs control of the indoor unit 100 (that may include the entire air-conditioning apparatus), such as the airflow rate of the fan 5 and the temperature of refrigerant passing through the indoor heat exchanger 4 (for maintaining the temperature), on the basis of, for example, an instruction from a user (an end user) transmitted through, for example, a remote controller. The controller 70 sends a signal to the notification device 40 such that an operating state, for example, is displayed, for example. In Embodiment 1, the controller 70 has a function as a wall process controller that determines a portion serving as a wall (especially an outer wall on which the indoor unit is placed) on the basis of the temperature detected by the temperature sensor 800. Based on the temperature at a location serving as a wall, the amount of heat (a thermal load of a room as an air-conditioned space) supplied from the indoor unit 100 is calculated. In this example, the controller 70 of the indoor unit 100 performs control, but another device that can communicate with the controller 70 may perform the control.

The controller 70 of Embodiment 1 is, for example, a microcomputer including an arithmetic processing unit for controlling such as a central processing unit (CPU). The controller 70 also includes a recording device (not shown) in which data on processing such as control is stored as a program. The arithmetic processing unit performs processing based on program data for control. The controller 70 may also include clocking means such as a timer so as to perform measurement on time (time of day).

(Airflow Direction Adjustment Device)

Figure 3:
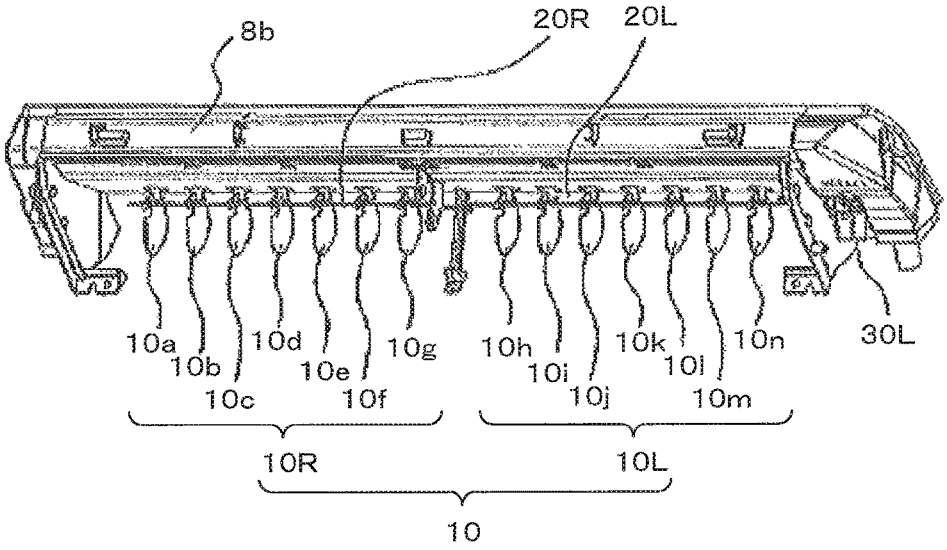
FIG. 3 illustrates a configuration of an airflow direction adjustment device disposed near an air outlet 7 in Embodiment 1 of the present invention.

FIG. 3 illustrates a configuration of an airflow direction adjustment device disposed near the air outlet 7 in Embodiment 1 of the present invention. As illustrated in FIGS. 2 and 3, the indoor unit 100 includes the airflow direction adjustment device that adjusts the air sending direction in which air that has passed through the indoor heat exchanger 4 is sent, near the air outlet 7. Lateral air deflectors 10 (a left lateral air deflector group 10L and a right lateral air deflector group 10R) adjust the air sending direction in the horizontal direction (the lateral direction). The vertical air deflectors 9 (a front vertical air deflector 9*a* and a rear vertical air deflector 9*b*) adjust the air sending direction in the vertical direction (the up-and-down direction).

(Vertical Air Deflector)

As illustrated in FIG. 2, the vertical air deflectors 9 have a rotation center in parallel to the horizontal direction and are disposed to the body 1 such that the vertical air deflectors 9 can rotate. The front vertical air deflectors 9*a* and the rear vertical air deflectors 9*b* adjust the angles of vertical air deflectors 9 by means of a drive means (not shown) with a motor. The vertical air deflectors 9 are not limited to the illustrated configuration, and the front vertical air deflector 9*a* and the rear vertical air deflector 9*b* may individually rotate by means of different motors. Each of the front and rear vertical air deflectors 9*a* and 9*b* may be divided into two at the center in the lateral direction, that is, the front and rear vertical air deflectors 9*a* and 9*b* may be divided into four in total, so that the obtained four parts individually rotate. Each of the vertical air deflectors 9 is constituted by two deflectors, that is, the front vertical air deflector 9*a* and the rear vertical air deflector 9*b*, but the number of deflectors is not specifically limited.

(Lateral Air Deflector)

As illustrated in FIG. 3, the right lateral air deflector group 10R includes lateral air deflectors 10*a*, 10*b*, . . . , and 10*g*, disposed on the lower surface 8*b* of the drain pan 8 such that the right lateral air deflector group 10R can rotate, and a right connecting rod 20R is connected to the lateral air deflectors 10*a*, 10*b*, . . . , and 10*g*. The left lateral air deflector group 10L includes lateral air deflectors 10*h*, 10*i*, . . . , and 10*n*, and a left connecting rod 20L is connected to the lateral air deflectors 10*h*, 10*i*, . . . , and 10*n*. The right lateral air deflector group 10R and the right connecting rod 20R form a link mechanism, the left lateral air deflector group 10L and the left connecting rod 20L form a link mechanism, a right drive means (not shown) and a left drive means 30L are respectively connected to the right connecting rod 20R and the left connecting rod 20L.

When the right connecting rod 20R is caused to move in parallel by the right drive means, the lateral air deflectors 10*a*, 10*b*, . . . , and 10*g* rotate while being in parallel to each other. Then, when the left connecting rod 20L is caused to move in parallel by the left drive means 30L, the lateral air deflectors 10*h*, 10*i*, . . . , and 10*n* rotate while being in parallel to each other. Thus, air can be sent in the same direction with respect to the entire width of the air outlet 7, in directions away from each other with respect to each half width of the air outlet 7, and in the directions approaching each other with respect to each half width of the air outlet 7. The lateral air deflectors 10 are not to those illustrated in FIG. 3, for example. For example, the number of the lateral air deflectors 10 is not specifically limited. The lateral air deflectors 10 may be divided into three or more groups such that each group is rotatably joined to the connecting rod and the connecting rod can move independently in parallel.

(Temperature Sensor 800)

Figure 4:
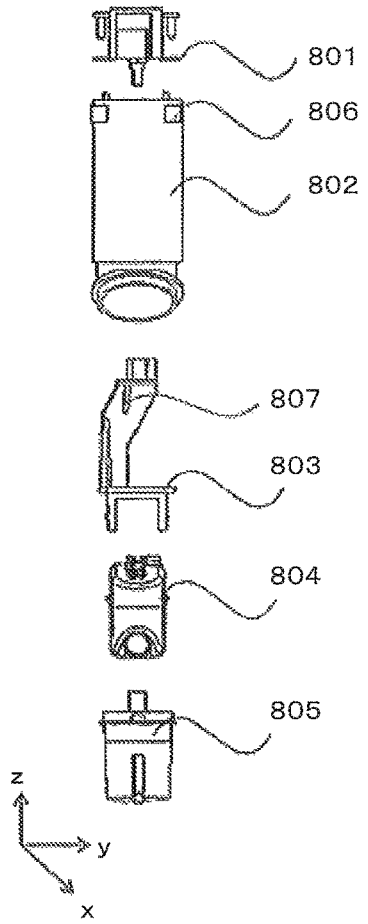
FIG. 4 is a view (a first view) illustrating a configuration of a temperature sensor 800 according to Embodiment 1 of the present invention.
Figure 5:
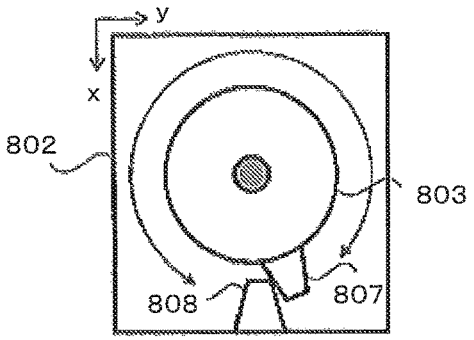
FIG. 5 is a view (a second view) illustrating a configuration of a temperature sensor 800 according to Embodiment 1 of the present invention.

FIGS. 4 and 5 illustrate a configuration of the temperature sensor 800 according to Embodiment 1 of the present invention. The temperature sensor 800 detects temperatures at a plurality of locations in a room (inside the room) that is an air-conditioning target. The temperature sensor 800 also detects the temperature of a target (a person), for example, in the room. As illustrated in FIG. 4, the motor 801 serving as a driver is constituted by, for example, a stepping motor. The motor 801 performs driving based on an instruction from the controller 70. Driving power of the motor 801 is transmitted to a power transmission part 803 so that a temperature detector 804 rotates (scans) horizontally. The driving of the motor 801 causes the temperature sensor 800 to rotate for approximately one turn. The temperature detector 804 is a sensor array in which a line constituted by 32 infrared ray sensors that are vertically aligned is disposed in a horizontal direction. The infrared ray sensors convert heat radiated from the object into an electric signal. The infrared ray sensors has a detection angle of approximately 60 degrees in the vertical direction, but has a narrow detection angle (approximately 8 degrees) in the horizontal direction in detecting the temperature. The temperature detector 804 scans in the horizontal direction so that the temperatures in all the horizontal directions can be detected, thereby creating two-dimensional temperature distribution (a thermal image).

The protective cover 805 protects the temperature detector 804 and forms the lower end of the rotation shaft. A transmission part cover 802 protects the power transmission part 803 and is installed on the body 1 through an attachment part 806. As illustrated in FIG. 5, the transmission part cover 802 includes a stopper 808. On the other hand, the power transmission part 803 has a rib 807. In Embodiment 1, the rib 807 comes into contact with the stopper 808 while the temperature detector 804 faces toward an installation wall surface. The temperature detector 804 faces in the direction in which the rib 807 projects. The rib 807 and the stopper 808 are used for determining an initial location. In Embodiment 1, it is assumed that the system requires initial positioning, which will be described later, in order to reduce the cost. However, for example, the system may not require initial positioning (e.g., a pattern, such as a Gray code, which is however expensive, that describes positional information on a motor, a transmission device, or other devices, or a rotary encoder). To detect the temperature corresponding to approximately one turn, 52 temperature detection operations need to be performed during scanning. The detected temperatures are joined in the scanning direction so that panorama thermal image indicating two-dimensional temperature distribution is generated. In the following description, the temperature sensor 800 performs scanning and temperature detection for generating a panorama thermal image. In this example, 52 temperature detection operations are performed. In the temperature sensor 800 of Embodiment 1, 32 infrared ray sensors are aligned, and sensor arrays having a detection angle of approximately 60 degrees in the vertical direction and a detection angle of approximately 8 degrees in the horizontal angle perform the temperature detection operation 52 times. However, the number of elements, the detection angle, and the number of operations are not specifically limited.

(Room Shape)

Figure 6:
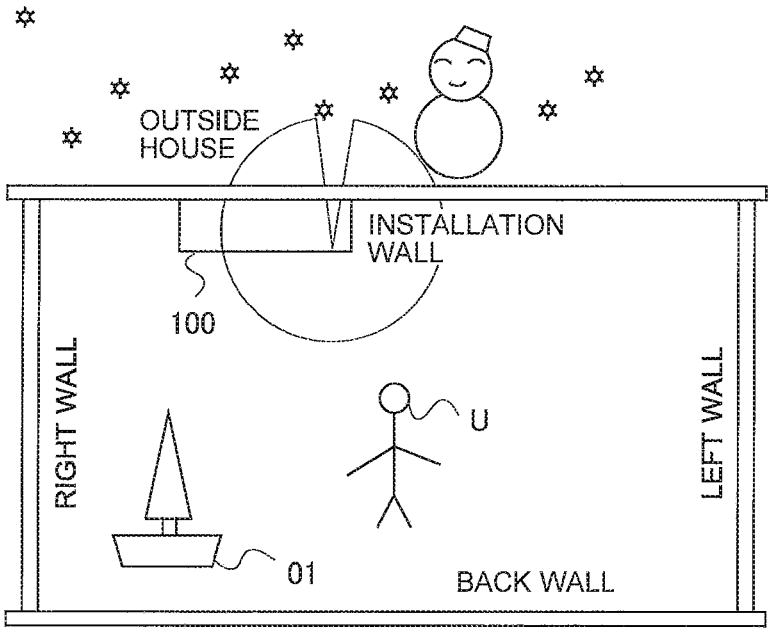
FIG. 6 is a view illustrating the state of a room according to Embodiment 1 of the present invention when viewed from above.

FIG. 6 is a view illustrating the state of a room according to Embodiment 1 of the present invention when viewed from above. FIG. 6 shows an end user U and an object O1 in order to illustrate the positional relationship in the room that is an air-conditioned space. In Embodiment 1, the indoor unit 100 is placed on the outer wall. The season is winter with low outdoor temperatures. The left wall and the right wall are defined when the inside of the room is seen from the indoor unit 100 (temperature sensor 800).

(Advantages)

After the operation of the air-conditioning apparatus has started, the controller 70 applies a stepped pulse to the motor 801 so that the motor 801 rotates counterclockwise. The location at which the rib 807 comes into contact with the stopper 808 and stops rotating is defined as an initial location. At the initial location, the temperature detector 804 faces a direction substantially opposite to the indoor direction. Thus, the temperature of the outer wall serving as the installation wall is detected. Since the temperature sensor 800 of Embodiment 1 projects from the body 1, it is possible to detect the temperature of the outer wall serving as the installation wall. The temperature detector 804 cannot be directed to a portion covered with the stopper 808, but this portion can be covered from the angle of detection of the temperature sensor 800 in the horizontal direction.

After initial positioning, the temperature sensor 800 is caused to detect the temperature. Temperature data having detection angles of 7 degrees in the horizontal direction and 60 degrees in the vertical direction where t=0 is obtained. In addition, a stepped pulse for causing the temperature detector 804 to rotate to 7 degrees is applied to the motor 801, and the temperature sensor 800 is caused to rotate clockwise, thereby changing the angle of temperature detection. After the angle change, a second (t=1) temperature detection is performed. This detection is repeated as t=2, 3, . . . with the angle of the temperature sensor 800 being repeatedly changed. The temperature detection is performed until the rib 807 comes into contact with the stopper 808, and then, the temperature detection operation for one turn is completed. To perform the temperature detection for one turn, the temperature sensor 800 performs temperature detection at least 52 times (up to t=51). In the foregoing manner, a panorama thermal image with 32×52 pixels can be obtained. Then, the temperature sensor 800 is caused to rotate counterclockwise and performs the similar operation. As described above, oscillating rotation relative to the stopper 808 is repeated so as to detect the indoor temperature, thereby obtaining panorama thermal image data. Since the principle is the same, only a panorama thermal image in the clockwise rotation will be described below.

Figure 7:
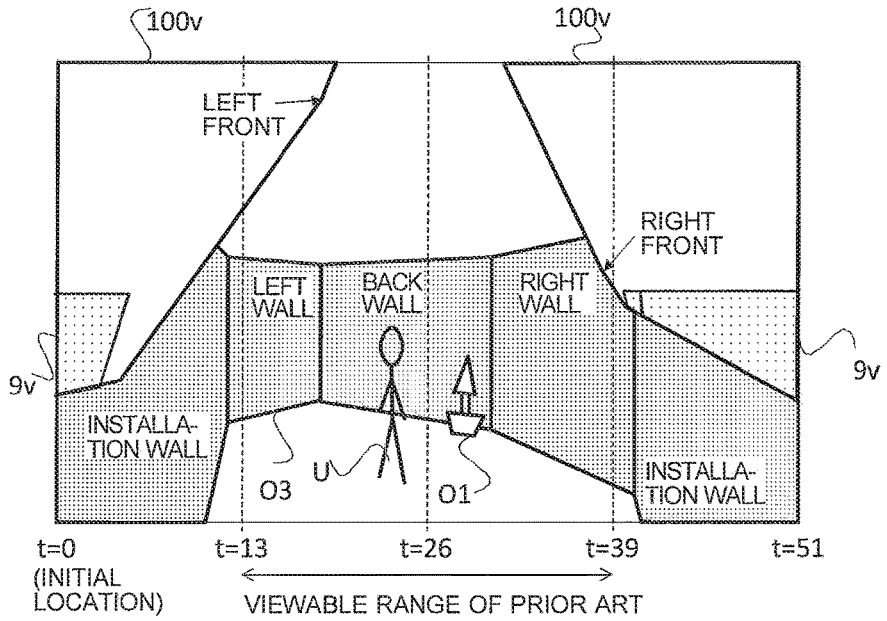
FIG. 7 is a schematic view (a first view) of an example of a panorama thermal image according to Embodiment 1 of the present invention.
Figure 8:
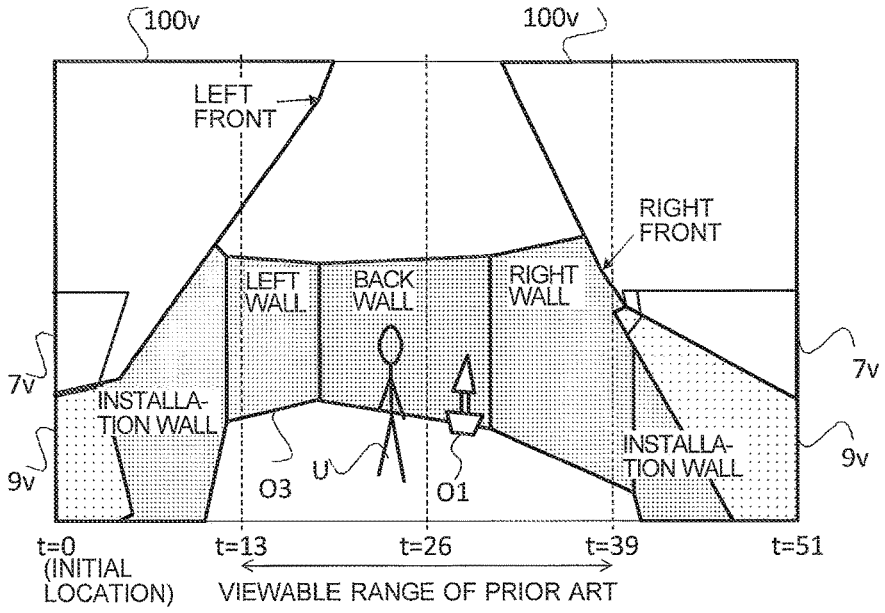
FIG. 8 is a schematic view (a second view) of an example of a panorama thermal image according to Embodiment 1 of the present invention.

FIGS. 7 and 8 schematically illustrate examples of a panorama thermal image in Embodiment 1 of the present invention. FIGS. 7 and 8 show panorama thermal images in the case of rotation for one turn with a horizontal detection angle of 7 degrees. FIG. 7 shows a panorama thermal image in a state in which the vertical air deflectors 9 are housed in the body 1. On the other hand, FIG. 8 shows a panorama thermal image in a state in which the vertical air deflectors 9 operate and move downward. In the drawings, 100v denotes an image (hereinafter referred to as an indoor unit thermal image 100v) in a panorama thermal image of the indoor unit 100. Reference character 9v denotes an image (hereinafter referred to as a vertical air deflector thermal image 9v) in the panorama thermal image of the vertical air deflectors 9. Reference character 7v denotes an image (hereinafter referred to as an air outlet thermal image 7v) in the panorama thermal image of the air outlet 7. Since FIGS. 7 and 8 are schematic views, images are simplified. However, actual panorama thermal images are displayed with especially horizontal lines being curved. In FIGS. 7 and 8, ranges detected by a conventional temperature sensor (motion detector) are indicated by dotted lines. Although the indoor unit thermal image 100v of the indoor unit 100 is located in upper portions in FIGS. 7 and 8, the left front, left rear, right front, and right rear of the surface of the body 1 are described for easing description of the positional relationship.

Referring to FIGS. 7 and 8, an operation of the temperature sensor 800 will be specifically described. Here, it is assumed that the initial location is at the left rear side. The temperature sensor 800 of the indoor unit 100 scans a closed room including the end user U and the object O1. At t=0, the temperature of the outer wall serving as the installation wall and the indoor unit 100 can be detected. With scanning at t=1, 2, and 3, . . . , the boundary (edge) can be determined based on the temperature difference in, for example, temperature between the outer wall and the left wall around t=13. A conventional motion detector, for example, has a narrow detection range, and thus cannot determine the presence of an edge or the like.

Around t=25, which is an approximately middle, the temperature of the end user U is detected and the presence thereof is detected. Around t=30, the temperature of the object O1 is detected, and the presence thereof is detected. Around t=40, the boundary between the outer wall and the right wall is detected. The conventional motion detector, for example, cannot detect the temperature at the boundary. In this situation, the temperature sensor 800 of Embodiment 1 can determine the rear vertical air deflector 9*b*. As a result, the temperatures of the air outlet 7 and the vertical air deflectors 9 can be detected as the air outlet thermal image 7*v* and the vertical air deflector thermal image 9*v*. In subsequent processes, the air outlet 7, the vertical air deflectors 9, and the installation wall surface are seen. In the foregoing manner, the temperature of the installation wall (outer wall), which is most important in Embodiment 1, can be detected.

Figure 9:
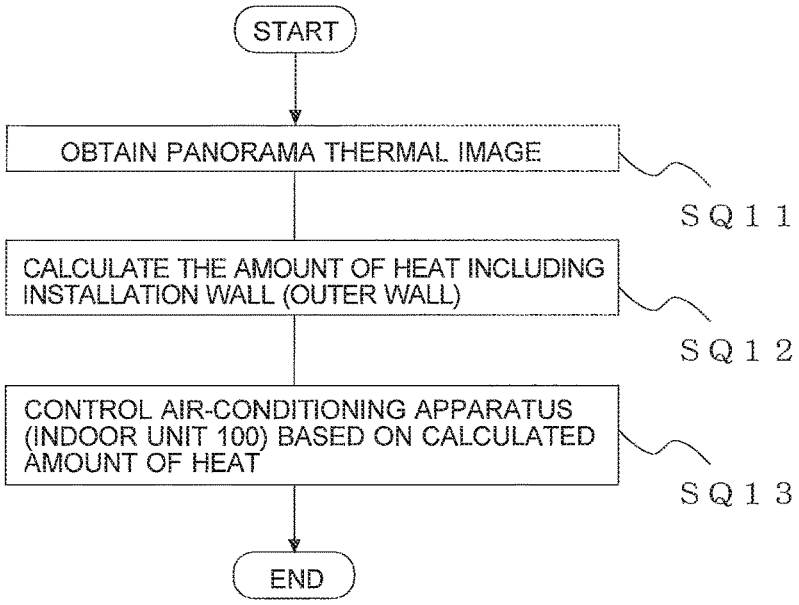
FIG. 9 is a flowchart showing processes of controlling the indoor unit 100 performed by a controller 70 according to Embodiment 1 of the present invention.

FIG. 9 is a flowchart showing processes of controlling the indoor unit 100 performed by the controller 70 of Embodiment 1 of the present invention. In subsequent Embodiments, a plurality of processes performed by the controller 70 will be described, where the processes may be performed in a time-division manner with processes based on the flowchart of FIG. 9 or in parallel by another controlling device, for example. First, at SQ11, the controller 70 obtains panorama thermal image data based on an operation of the temperature sensor 800. The panorama thermal image data can be obtained in the manner described above. At SQ12, a necessary amount of heat including the outer wall is calculated based on the panorama thermal image data. The thermal calculation may employ various known techniques. The sensible temperature may be calculated by using, but not limited to, the temperature of the outer wall serving as the installation wall. Then, at SQ13, based on the calculated amount of heat, the air-conditioning apparatus (e.g., the evaporating temperature and the condensing temperature of the indoor heat exchanger 4) and the airflow rate of the fan 5, for example, are controlled. The foregoing process is repeatedly performed during operation of the air-conditioning apparatus.

(Advantages)

As described above, in the indoor unit 100 of Embodiment 1, the temperature sensor 800 projects from the body 1 and is caused rotate by approximately 360 degrees for temperature detection. Thus, the temperature can be detected in a wide range including the installation wall (the outer wall). In addition, even in cases where the outer wall is cold or warm because of the outdoor air, appropriate thermal calculation can be performed, thereby enabling air at more comfortable temperature, for example, to be sent into the room.

For example, in FIG. 6, the amount of heat in a room having a height of 2.5 m and an area corresponding to 10 tatami mats (approximately 39 $m^3$ (cubic meters)) is examined. Here, the case of increasing the temperature of the room by 1 degree C. will be discussed. For example, suppose the specific heat of the air is 1.006 [J/g·K] and the weight of air per 1 $m^3$ is 1293 g. Then, the necessary amount of heat is 1.006 [J/(g·K)]×1293 [g/$m^3$]×1 [K]×39 [$m^3$]=approximately 51000 J (approximately 212 kcal).

At step SQ12 described above, the easiest method for calculating the amount of heat, for example, is a method of calculating the temperature based on a comparison between the temperature obtained by simply averaging the temperatures of the left wall, the right wall, the back wall, and the outer wall serving as the installation wall and a set temperature. The amount of heat is calculated after correction of, for example, the temperature of the walls in some cases. However, this calculation is complicated, and description thereof is omitted. In a conventional technique, the temperature of the outer wall serving as the installation wall cannot be included in calculation, but in Embodiment 1, the temperature of the outer wall can be included in calculation. For example, suppose the set temperature is 20 degrees C., and the temperatures of the left wall, the right wall, and the back wall are 17 degrees C. The outer wall serving as the installation wall is 9 degrees C. because the outer wall is separated from the outdoor air.

In this case, the amount of heat obtained by the conventional calculation and the amount of heat obtained in Embodiment 1 are:

(20−(17+17+17)/3)×51000 [J/K]=153000 JConventional calculation:

(20−(17+17+17+9)/4)*51000 [J/K]=255000 J. Embodiment 1:

The, the amount of heat obtained by the conventional calculation is in short, that is, smaller by 100000 J than the amount of heat obtained in Embodiment 1 in consideration of the temperature of the outer wall. In the conventional calculation, various corrections are needed because the temperature of the outer wall is unknown. As a result, the calculation of the amount of heat is complicated and calculation by controller 70 requires a large number of processes. In addition, the processing speed slightly decreases. In Embodiment 1, the temperature of the outer wall serving as the installation wall is directly detected and reflected in thermal calculation. Thus, a smaller number of corrections are needed, and the number of processes can be reduced. Furthermore, since the temperature of the outer wall is obtained not by correction but by detection, the required accuracy in the amount of heat can be enhanced.

In a case where the installation wall is the outer wall as in Embodiment 1, the detection is easily affected by the temperature of outdoor air. For example, if the outside of the room is cold, it is hypothesized that the temperature sensible by a person is low. Thus, the heat higher than the set temperature may be taken into the room. For example, in the above-described thermal calculation of the average temperature of the walls, the weight of the temperature of the outer wall may be doubled ((i.e., left wall+right wall+back wall+installation wall surface×2)/5). The assignment of weight to the temperature of the outer wall enables thermal calculation to be closer to the sensible temperature, thereby making the room comfortable.

As described above, the temperature of the installation wall surface (the outer wall) can be directly detected so that thermal calculation can be accurately performed even in seasons such as cold winter with the cold outer wall and hot summer with the warmed outer wall. In addition, since the detected temperature of the outer wall can be used for adjustment of the sensible temperature of the end user, air can be sent into the room at a more comfortable airflow rate, for example.

Embodiment 2

Figure 10:
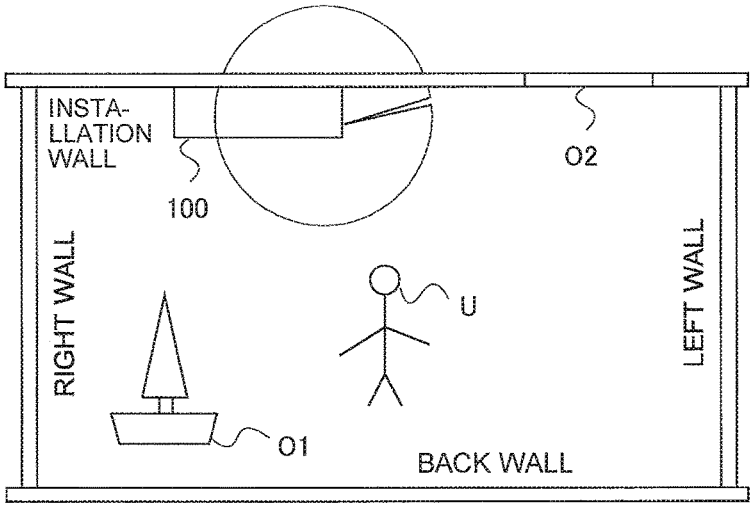
FIG. 10 is a view illustrating the state of a room according to Embodiment 2 of the present invention when viewed from above.

FIG. 10 is a view illustrating the state of a room according to Embodiment 2 of the present invention when viewed from above. It is assumed that the wall separating the room of Embodiment 2 serving as a space of an air-conditioning target has a window O2 in the installation wall surface. Heat easily escapes from the room through the window. In view of this, in Embodiment 2, an indoor unit 100 that can notify an end user of opening or closing of a curtain will be described. Here, a configuration of the indoor unit 100 of Embodiment 2 is substantially the same as the configuration of the indoor unit 100 described in Embodiment 1. In Embodiment 2, a controller 70 has a function as a window process controller, for example, determines a portion serving as a window based on panorama thermal image data, and performs processes regarding the window and the curtain.

(Advantages)

Figure 11:
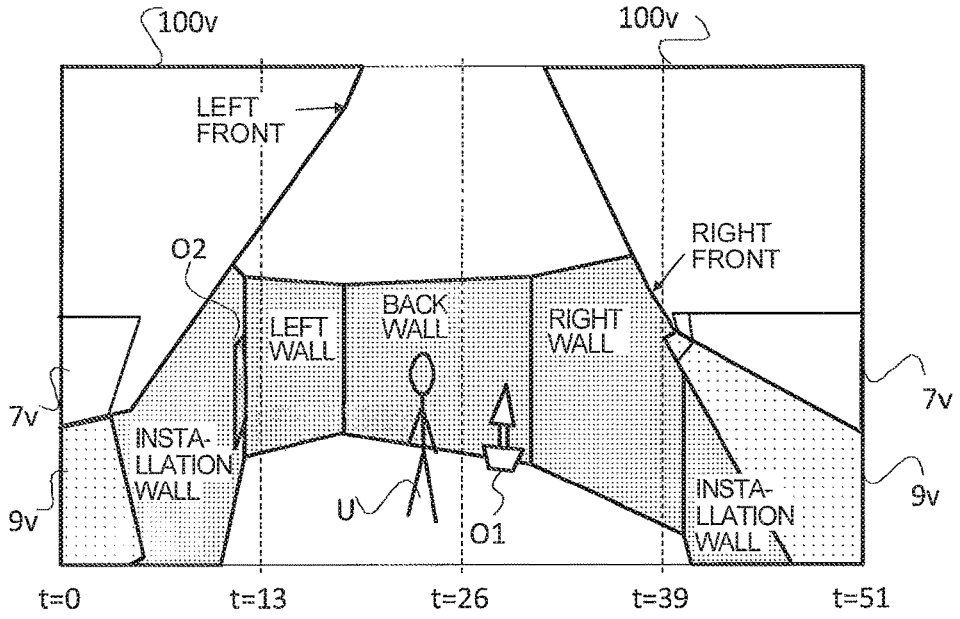
FIG. 11 schematically illustrates an example of a panorama thermal image in Embodiment 2 of the present invention.

FIG. 11 schematically illustrates an example of a panorama thermal image in Embodiment 2 of the present invention. As illustrated in FIG. 11, a temperature sensor 800 of the indoor unit 100 of Embodiment 2 can detect the temperature of the window O2 in the installation wall surface. Here, a case where window O2 curtain is provided will be described.

Figure 12:
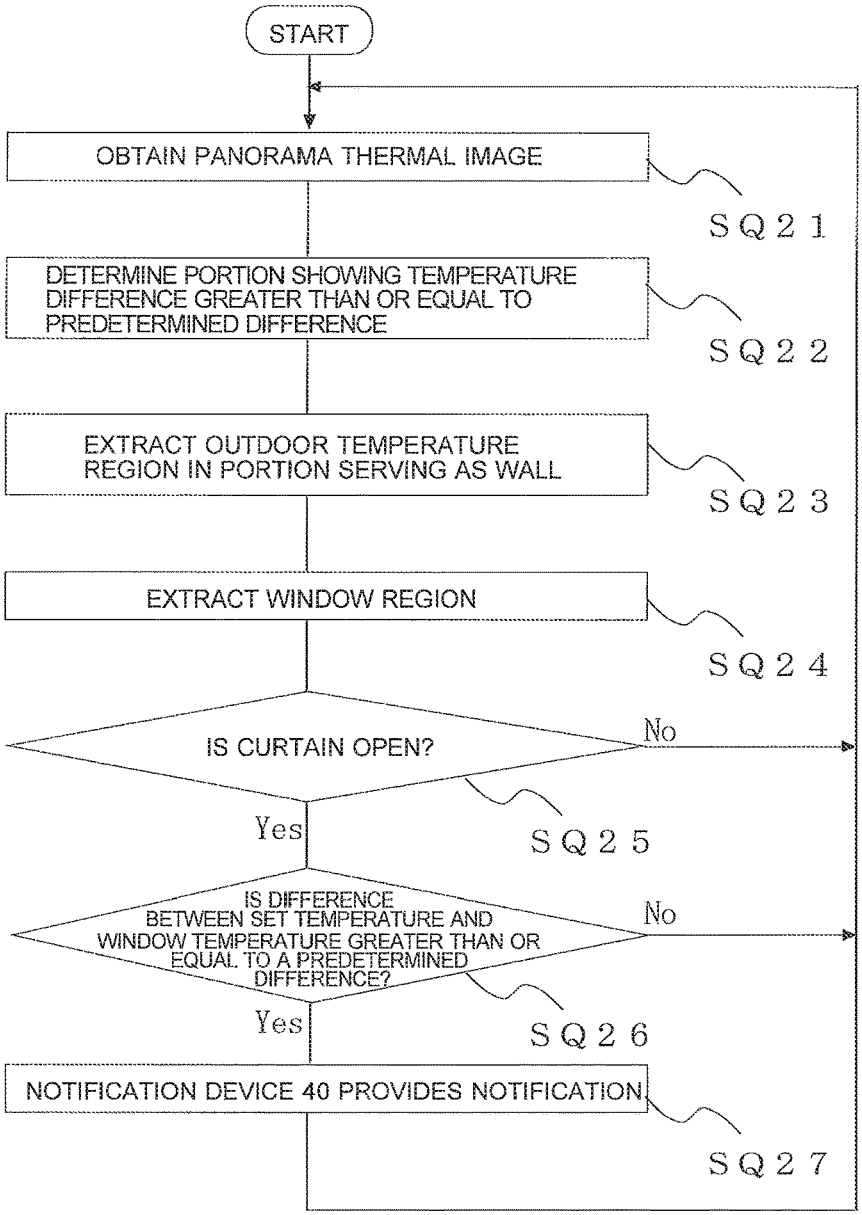
FIG. 12 is a flowchart showing processes of controlling an indoor unit 100 performed by a controller 70 according to Embodiment 2 of the present invention.

FIG. 12 is a flowchart showing processes of controlling the indoor unit 100 performed by the controller 70 of Embodiment 2 of the present invention.

First, at SQ21, the controller 70 obtains panorama thermal image data based on the operation of the temperature sensor 800. Since the process in SQ21 is the same as that in SQ11 described in Embodiment 1, processes subsequent to SQ22 may be performed by using panorama thermal image data obtained by the process at SQ11.

At SQ22, it is determined whether there is a region showing a temperature difference greater than or equal to a predetermined difference. In general, the window is warmer than the wall in summer, and colder than the wall in winter. This is because the window is more susceptible to the influence of outdoor air than the wall. Then, at SQ23, for a portion serving as a wall, an outdoor-air temperature region is extracted. Thereafter, at SQ24, a window region is extracted (i.e., a portion serving as the window is detected).

Once the window region is extracted, the controller 70 monitors a change with time in the temperature at the window region, thereby determining opening/closing of the curtain. For example, if the curtain is open, it is necessary to supply the amount of heat more than that obtained by thermal calculation. In view of this, in order not dissipate heat from the room through the window, the curtain needs to be closed.

At SQ25, it is determined whether the curtain in the window region is open based on the temperature detected by the temperature sensor 800. If it is determined that the curtain is open, then it is determined at SQ26 whether the difference between the set temperature and the temperature of the window (or the wall) is greater than or equal to a predetermined temperature difference. If the difference is determined to be greater than or equal to the predetermined temperature difference, at SQ27, a signal of instructing that the curtain is closed is transmitted to the notification device 40, and the end user is notified of the signal. Here, the notification is provided by displaying in the notification device 40, but may be provided by means of sound (voice). Alternatively, the notification may be provided by, for example, displaying on a connected remote controller or other components.

(Advantages)

As described above, the indoor unit 100 of Embodiment 2 can obtain the same advantages as those of the indoor unit 100 of Embodiment 1. In addition, since a window region of the installation wall surface (the outer wall) can be extracted, the window can be monitored. The monitoring of the window can provide a notification of closing the curtain in a case where the temperature difference between the room and the outdoor air is large, and dissipation of heat from the window can be reduced. Thus, energy can be saved.

Embodiment 3

(Configuration)

Figure 13:
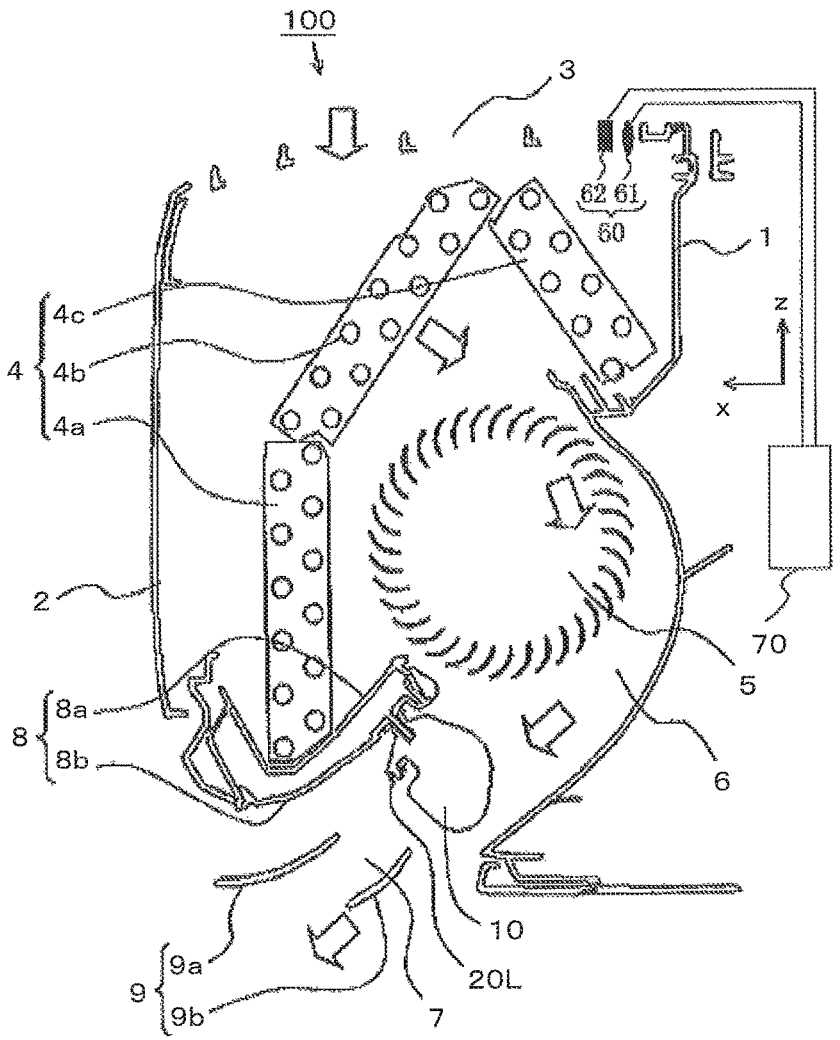
FIG. 13 is a sectional view schematically illustrating an internal configuration of an indoor unit 100 according to Embodiment 3 of the present invention.

FIG. 13 is a sectional view schematically illustrating an internal configuration of an indoor unit 100 according to Embodiment 3 of the present invention. In FIG. 13, components designated by the same reference signs as those in FIG. 2 are assumed to perform operations and processes, for example, similar to those described in Embodiment 1.

An intake air temperature condition detector 60 includes a temperature sensor 61 that detects a dry-bulb temperature (hereinafter referred to as a temperature) near an air inlet 3 and a humidity sensor 62 that detects a relative humidity (hereinafter referred to as a humidity) near the air inlet 3. The temperature sensor 61 and the humidity sensor 62 are disposed near the air inlet 3. A controller 70 of Embodiment 3 calculates a dewpoint temperature (a temperature at which steam changes to water), on the basis of the temperature detected by the temperature sensor 61 and the humidity detected by the humidity sensor 62. Here, a method for calculating the dewpoint temperature, such as a method based on "humidity chart" and a method based on the table in JIS8806, are not specifically limited.

In Embodiment 3, to prevent dew condensation on airflow direction adjustment devices (especially the vertical air deflectors 9), a portion serving as vertical air deflectors 9 is determined based on the panorama thermal image data, and the state of dew condensation is determined based on the temperature at the vertical air deflectors 9 and the dewpoint temperature. Based on the determination, an air deflector driver (not shown) is driven, thereby providing the function as a deflector process controller that controls the vertical air deflectors 9.

First, dew condensation will be described. For example, the case of cooling a room at a temperature of 30 degrees C. with a humidity of 80% will be described. The indoor unit 100 sucks air at a temperature of 30 degrees C. with a humidity of 80% into the body 1 through the air inlet 3. The dewpoint temperature in this case is 26 degrees C. Thus, this air is cooled to 26 degrees C. or lower, part of steam becomes dew (water).

The controller 70 obtains, as data, the temperature and humidity of a room from the intake air temperature condition detector 60. From the data on the temperature and the data on the humidity, the temperature of air to be sent from the air outlet 7 is determined based on the temperature, and a refrigeration cycle is operated in accordance with the determined air temperature. Here, the blowing temperature is 20 degrees C. At this time, dew is generated mainly in the indoor heat exchanger 4, but dew generated in the body 1 is collected. Air at a temperature of 20 degrees C. with a humidity of 100% is sent from the air outlet 7.

Here, during operation, possible dew condensation on airflow direction adjustment devices (especially vertical air deflectors 9 outside the body 1) cannot be collected. The vertical air deflectors 9 themselves are kept at around the blowing temperature (20 degrees C.). For example, depending on the way of sending air, the vertical air deflectors 9 might come into contact with the room air (at a temperature of 30 degrees C. and a humidity of 80%) during operation. The vertical air deflectors 9 might also come into contact with the room air in a case where an air current passing in a path different from an air passage 6. The room air is cooled by air from the body 1 and changes into air at a temperature of 26 degrees C. or less with a humidity of about 100%. When this air strikes the vertical air deflectors 9, condensation can occur. Water drops generated by dew condensation on the lateral air deflectors 10 of the body 1 might also come into contact with the vertical air deflectors 9. In both of these cases, it is common that the temperature and humidity of room air are high when dew is generated.

On the other hand, dew condensation can be prevented immediately before dew condensation is generated on the vertical air deflectors 9. Specifically, the operation of the air-conditioning apparatus is stopped, and the vertical air deflectors 9 are temporarily housed in the body 1 and dried for a short period so that condensation can be prevented. While the vertical air deflectors 9 are housed in the body 1, the operation of the air-conditioning apparatus is stopped and air is not sent into the room. Thus, comfort cannot be provided to the end user.

For example, since the temperature of the vertical air deflectors 9 cannot be detected in the conventional technique, the operation stop of the air-conditioning apparatus for preventing dew condensation is performed at regular intervals. Thus, the efficiency might be degraded by regularly stopping the operation without dew condensation, and water drops are generated by not stopping the operation until a predetermined time has elapsed after generation of dew condensation. In the indoor unit 100 of Embodiment 3, the temperature of the vertical air deflectors 9 is detected so that the operation for preventing dew condensation on the vertical air deflectors 9 can be performed not by time management but is performed when necessary.

(Advantages)

Figure 14:
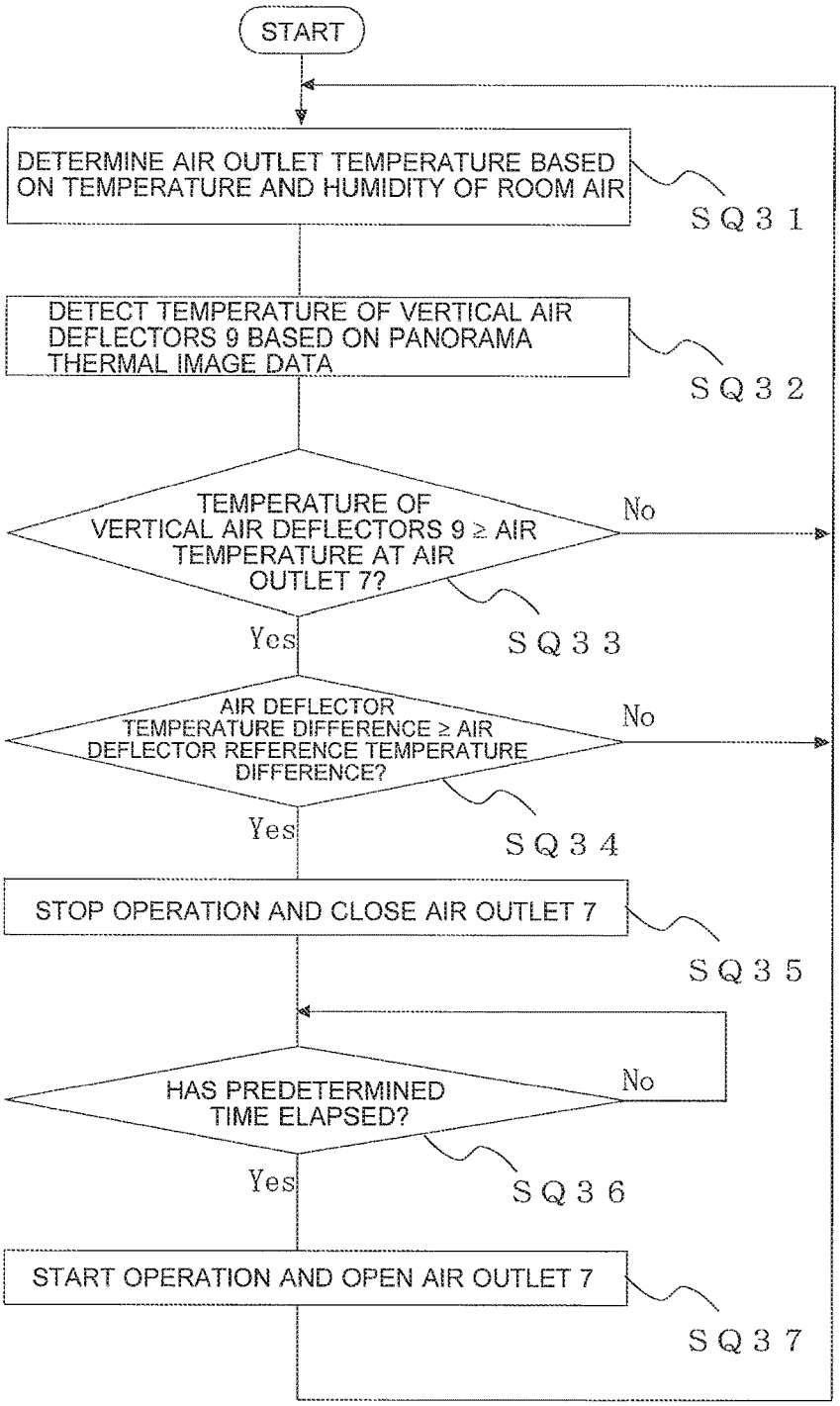
FIG. 14 is a flowchart showing processes of controlling the indoor unit 100 performed by a controller 70 according to Embodiment 3 of the present invention.

FIG. 14 is a flowchart showing processes of controlling the indoor unit 100 performed by the controller 70 according to Embodiment 3 of the present invention. After an operation has started, at SQ31, based on the temperature and humidity of the room detected by the intake air temperature condition detector 60, the temperature of air that is to pass through the indoor heat exchanger 4 and to be sent from the air outlet 7 is determined. Then, at SQ32, a panorama thermal image is obtained and a region corresponding to the vertical air deflectors 9 is extracted so that the temperature of the vertical air deflectors 9 is detected. Thereafter, at SQ33, it is determined whether the temperature of the vertical air deflectors 9 is greater than or equal to the temperature of air at the air outlet 7 that relates to determination. If it is determined that the temperature of the vertical air deflectors 9 is not greater than or equal to the temperature of air at the air outlet 7, the process returns to SQ31.

If it is determined that the temperature of the vertical air deflectors 9 is greater than or equal to the temperature of air at the air outlet 7, at SQ34, it is determined whether the temperature difference (difference in deflector temperature) between the temperature of the vertical air deflectors 9 and the temperature of air at the air outlet 7 for determination is greater than or equal to a predetermined deflector standard temperature. Here, the deflector standard temperature is set at a temperature that is considered abnormal as the temperature of the vertical air deflectors 9. If it is determined that the difference of deflector temperature is not greater than or equal to the deflector standard temperature, the process returns to SQ31. If it is determined that the difference of deflector temperature is greater than or equal to the deflector standard temperature, at SQ35, the operation of the air-conditioning apparatus (the indoor unit 100) is stopped, and the air outlet 7 is closed by the vertical air deflectors 9.

After the air outlet 7 has been closed, at SQ36, it is determined whether a predetermined time has elapsed. If the predetermined time has not elapsed, the process waits for the lapse. If it is determined that the predetermined period has lapsed, at SQ37, the operation of the air-conditioning apparatus is started, and the vertical air deflectors 9 are opened. Then, the process returns to SQ31.

Here, in SQ31 through SQ33, the temperature decreasing state of the vertical air deflectors 9 may be monitored. Alternatively, the temperature decreasing state may wait based on time. In addition, SQ36, after a predetermined time is elapsed, the temperature of the vertical air deflectors 9 is detected, and an operation of determining whether the vertical air deflectors 9 are dried or not based on the detected temperature. If it is determined that the vertical air deflectors 9 are not dried, drying is performed by further extending a wait time.

(Advantages)

As described above, the indoor unit 100 of the Embodiment 3 can obtain the same advantages as those of the indoor unit 100 of Embodiment 1. In addition, since the air-outlet set temperature and the temperature of the vertical air deflectors 9 can be detected and directly monitored, the state of dew condensation on the vertical air deflectors 9 can be accurately determined. Thus, the vertical air deflectors 9 (the airflow direction adjustment devices) can be dried in an optimum time. Since the vertical air deflectors 9 can determine the state before dew condensation, it is possible to prevent at least dew (water) from dropping onto the room (e.g., the floor) from the body 1. In addition, it is possible to determine whether the temperature of outlet air is abnormal. Furthermore, the position of the vertical air deflectors 9 can be determined so that it is possible to determine whether the vertical air deflectors 9 are at the position as specified. It is also possible to detect abnormality such as a case where the end user forces to touch the vertical air deflectors 9 by hand.

Embodiment 4

Figure 15:
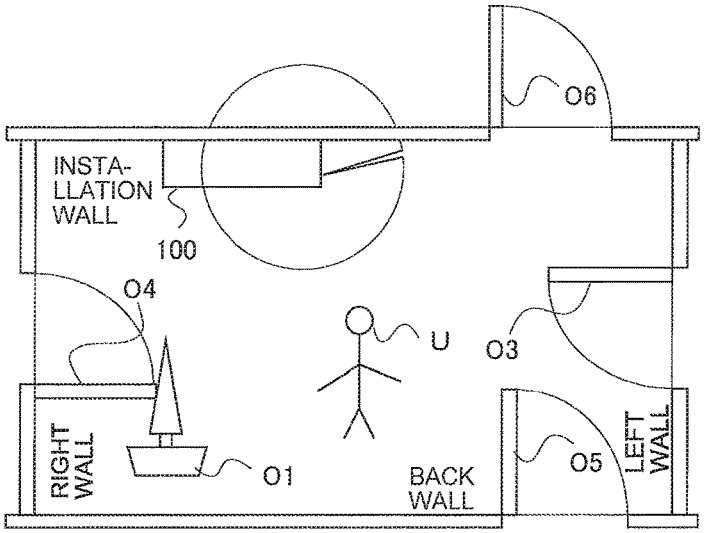
FIG. 15 is a view illustrating the state of a room according to Embodiment 4 of the present invention when viewed from above.

FIG. 15 is a view illustrating the state of a room according to Embodiment 4 of the present invention when viewed from above. It is assumed that a door (an entrance) is provided on each wall partitioning a room that is an air-conditioning target space in Embodiment 4. Here, a door O3, a door O4, a door O5, and a door O6 are respectively provided at the left wall, the right wall, the back wall, and the installation wall of an indoor unit 100, respectively. In Embodiment 4, the installation wall is not an outer wall facing, for example, outdoor air but a wall partitioning the room from a neighboring room. The type of each door (e.g., an outward-opening door, an inward-opening door, or a sliding door) is not specifically limited. A configuration of the indoor unit 100 of Embodiment 4 is substantially the same as the configuration of the indoor unit 100 described in Embodiment 1. In Embodiment 4, a controller 70 has a function as an entrance process controller, for example, determines a position serving as a door that is an entrance, on the basis of panorama thermal image data, and performs processes that relate to the doors.

(Advantages)

Figure 16:
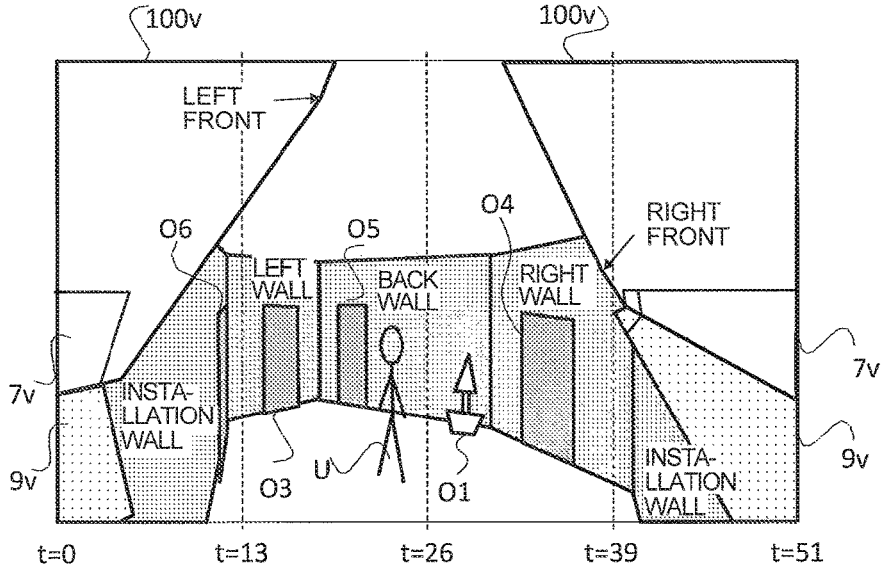
FIG. 16 schematically illustrates an example of a panorama thermal image in Embodiment 4 of the present invention.

FIG. 16 schematically illustrates an example of a panorama thermal image in Embodiment 4 of the present invention. In the indoor unit 100 of Embodiment 4, the temperature sensor 800 detects all the regions corresponding to the door O3 through the door O6 in the room and detects the temperatures in the regions. In particular, in the indoor unit 100 of Embodiment 4, since the scanning range of the temperature sensor 800 is large, the door O6 of the installation wall can be detected.

Figure 17:
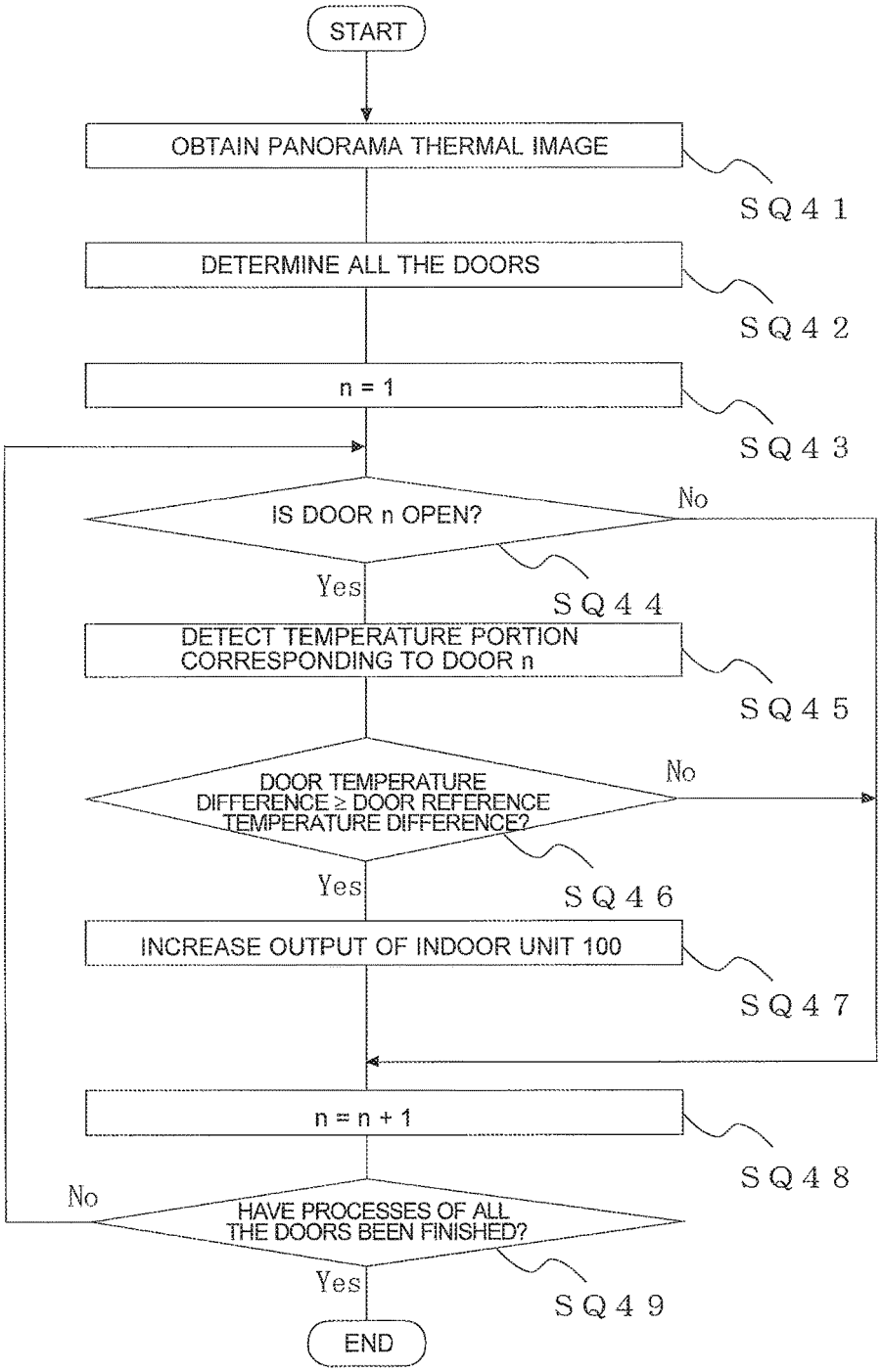
FIG. 17 is a flowchart showing processes of controlling an indoor unit 100 performed by a controller 70 according to Embodiment 4 of the present invention.

FIG. 17 is a flowchart showing processes of controlling the indoor unit 100 performed by a controller 70 of Embodiment 4 of the present invention. When an operation starts, the controller 70 obtains panorama thermal image data on the basis of the operation of a temperature sensor 800 at SQ41. Then, at SQ42, regions corresponding to all the doors are extracted, and the doors are determined. Thereafter, at SQ43, processes for the doors are performed from the door where n=1 with reference to the number n (where n=1, 2, 3, and 4 in Embodiment 4) assigned to the doors.

Then, at SQ44, it is determined whether a door is open. If it is determined that the door is not open (i.e., is closed), a process for this door is finished. On the other hand, if it is determined that the door is open, this detection means that the temperature on the farside of the door is detected. Thus, at SQ45, the temperature in the extracted region corresponding to the door is detected. Subsequently, at SQ46, it is determined whether the temperature difference (door temperature difference) between the temperature at the region corresponding to the door n and the room is greater than or equal to a predetermined temperature difference (standard door temperature difference). If it is determined that the door temperature difference is not greater than or equal to the standard door temperature difference, the process on the door n is finished. On the other hand, if it is determined that the door temperature difference is greater than or equal to the standard door temperature difference, output of the indoor unit 100, for example, is increased at SQ47 so that the room including the farside on the door is air-conditioned. Then, at SQ48, n=n+1 is established. At SQ49, it is then determined whether processes on all the doors are finished. If it is determined that the processes are not finished, the process returns to SQ44, and a process is performed on the next door. If it is determined that the processes are finished, processes on the doors are terminated.

(Advantages)

As described above, in the indoor unit 100 of Embodiment 4, the temperature sensor 800 can detect all the doors (especially the door at the installation wall) of the room. If one of the doors is open, for example, the temperature in a region on the farside of the door can be detected. For example, in a case where the temperature in a region on the farside of the door is lower than the room temperature in a heating operation or a case where the temperature in a region on the farside of the door is higher than the room temperature in a cooling operation, the room including the region on the farside of the room can be air-conditioned. Thus, comfort of the end user can be enhanced. Here, at SQ46, in a case where the temperature in a region on the farside of the door is higher than the room temperature in a heating operation or a case where the temperature in a region on the farside of the door is lower than the room temperature in a cooling operation, energy saving may be tried by reducing output (the amount of supplied heat) from the indoor unit 100. In a case where the temperature difference between the region on the farside of the door and the room temperature is large, notification of opening the door can be issued.

Embodiment 5

Figure 18:
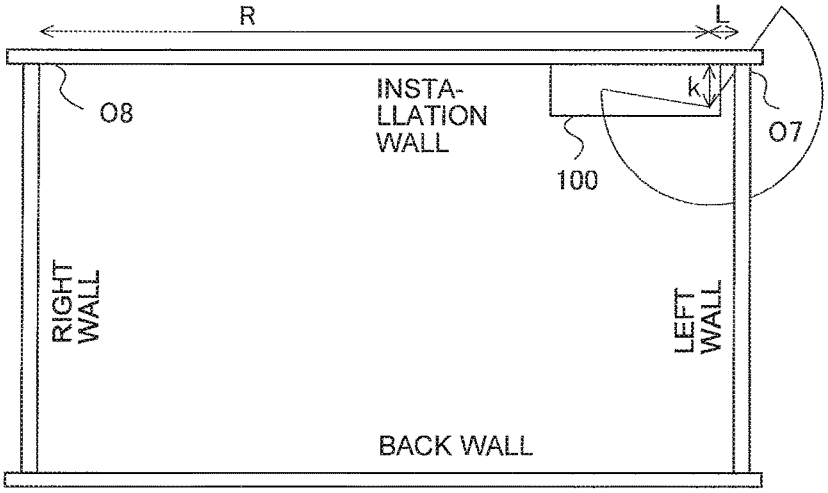
FIG. 18 is a view illustrating the state of a room according to Embodiment 5 of the present invention when viewed from above.
Figure 19:
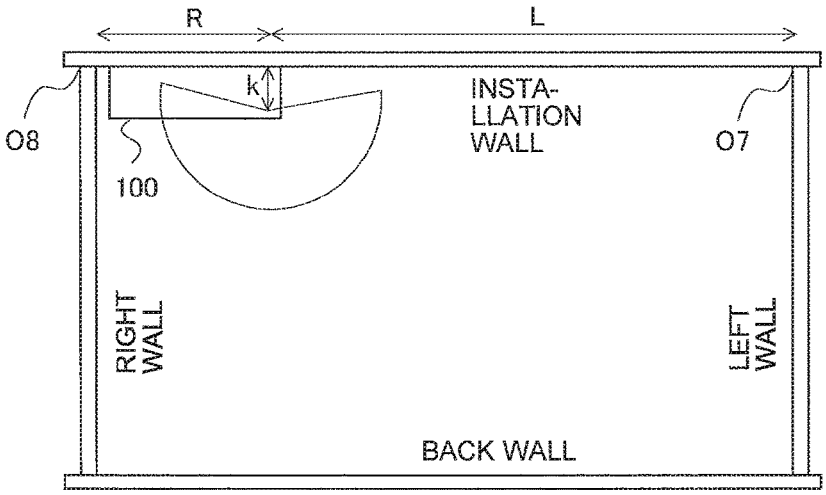
FIG. 19 is a view illustrating another example of the state of the room according to Embodiment 5 of the present invention when viewed from above.

FIG. 18 is a view illustrating the state of a room according to Embodiment 5 of the present invention when viewed from above. FIG. 19 is a view illustrating another example of the state of the room according to Embodiment 5 of the present invention when viewed from above. In FIG. 18, an indoor unit 100 is placed on the left wall side. On the other hand, in FIG. 19, the indoor unit 100 is placed on the right wall side. In Embodiment 5, a controller 70 determines walls on both sides of the installation wall and the floor based on panorama thermal image data, and has a function as an installation location process controller that derives the installation location of the indoor unit 100 in a room based on the determination.

Figure 20:
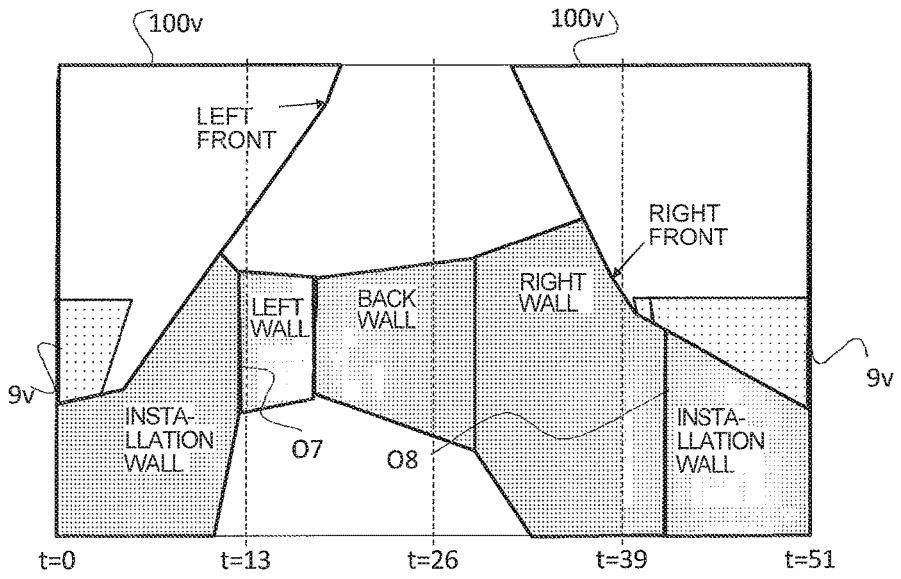
FIG. 20 shows a panorama thermal image in a case where the indoor unit 100 is placed at the location illustrated in FIG. 18.
Figure 21:
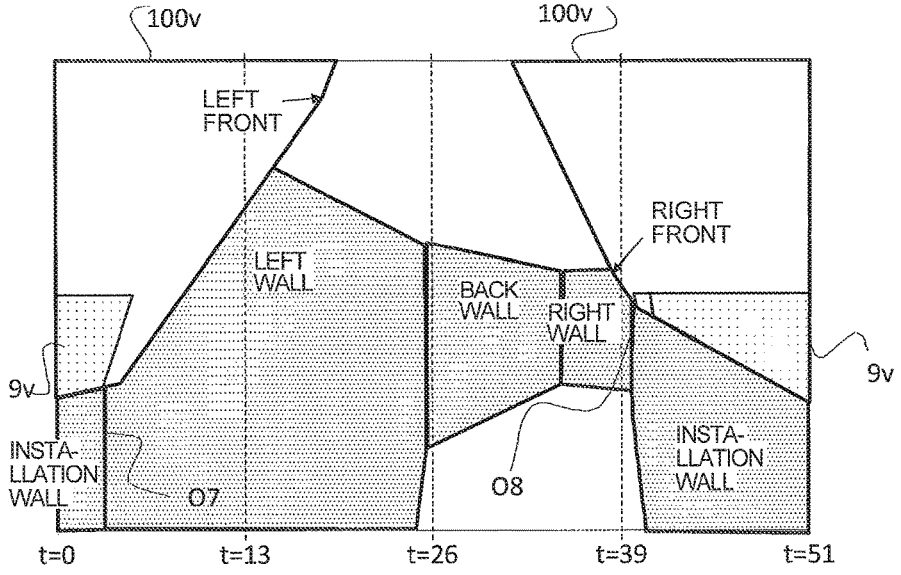
FIG. 21 shows a panorama thermal image in a case where the indoor unit 100 is placed at the location illustrated in FIG. 19.

FIG. 20 shows a panorama thermal image in a case where the indoor unit 100 is placed at the location illustrated in FIG. 18. FIG. 21 shows a panorama thermal image in a case where the indoor unit 100 is placed at the location illustrated in FIG. 19. The boundary between the installation wall and the left wall is defined as an edge O7. The boundary between the installation wall and the right wall is defined as an edge O8. Here, the temperature of the edge O7 is detected around t=10 in FIG. 20 and around t=5 in FIG. 21. The temperature of the edge O8 is detected around t=43 in FIG. 20 and around t=41 in FIG. 21. In FIGS. 20 and 21, the vertical air deflectors 9 are housed in the body 1.

(Advantages)

Figure 22:
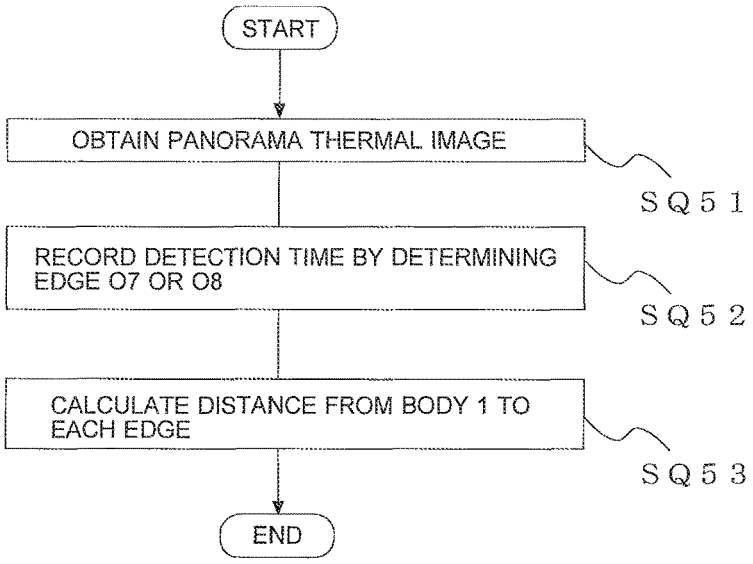
FIG. 22 is a flowchart showing processes of controlling the indoor unit 100 performed by a controller 70 according to Embodiment 5 of the present invention.

FIG. 22 is a flowchart showing processes of controlling the indoor unit 100 performed by the controller 70 of Embodiment 5 of the present invention. When an operation starts, the controller 70 obtains panorama thermal image data on the basis of the operation of a temperature sensor 800 at SQ51. Then, at SQ52, the edge O7 as the boundary between the installation wall and the left wall and the edge O8 as the boundary between the installation wall and the right wall are detected. In addition, times when these boundaries are detected are recorded.

Thereafter, at SQ53, the angle to each wall surface is calculated. First, suppose the detection time of the edge O7 or the edge O8 is t, conversion into an angle from the initial location of the edge O7 or the edge O8 based on the detection time t is performed. In Embodiment 5, the relationship:

$$\text{Edge detection angle } E=(t/52)\times 360 \text{ degrees}$$

where E is an edge detection angle is established.

Then the distance between the body 1 (the temperature sensor 800) and each edge is obtained as:

$$\text{Distance } L \text{ to edge } O7=K\times\tan(\text{edge detection angle } E \text{ of edge } O7)$$

$$\text{Distance } R \text{ to edge } O8=K\times\tan(\text{edge detection angle } E \text{ of edge } O8)$$

where K (known) is the distance from the installation wall to the temperature sensor 800.

The height of the indoor unit 100 installed on the installation wall can also be derived. For example, on the basis of thermal images shown in FIGS. 20 and 21, contact point between the edge O7 or the edge O8 and the floor can be detected. For example, suppose the angle in the vertical direction in a case where a contact point between the edge O7 and the floor is F, $$\text{Height of indoor unit } 100=L\times\tan(F)$$

is established. In the foregoing manner, since the height of the installation location of the indoor unit 100 on the installation wall from the floor is determined, air can be caused to strike the wall when necessary. Detailed description thereof is omitted.

(Advantages)

As described above, in the indoor unit 100 of Embodiment 5, the temperature sensor 800 can detect the edge O7 or O8 that are respectively the boundary between the installation wall and the left or right wall. Then, the distance between the temperature sensor 800 and the edge O7 or O8 and the height from the floor are calculated, for example, thereby determining the installation location of the indoor unit 100. For example, to adjust the direction of air flow at the highest temperature, the installation location of the indoor unit 100 can be utilized.

For example, in the room illustrated in FIG. 18, since the indoor unit 100 is placed on the left wall side, it can be recognized that no person is present on the left of the indoor unit 100. On the other hand, in the room illustrated in FIG. 19, since the indoor unit 100 is placed on the right wall side, it can be recognized that no person is present on the right. After the operation has started and until the room temperature reaches a set temperature, the temperature adjustment is performed including the wall. Once air-conditioning is stabilized, air is not sent to the wall but is sent to a person. At this time, air is not sent to the left in FIG. 18 and to the right in FIG. 19 so that more comfortable air can be sent to the person.

Embodiment 6

Figure 23:
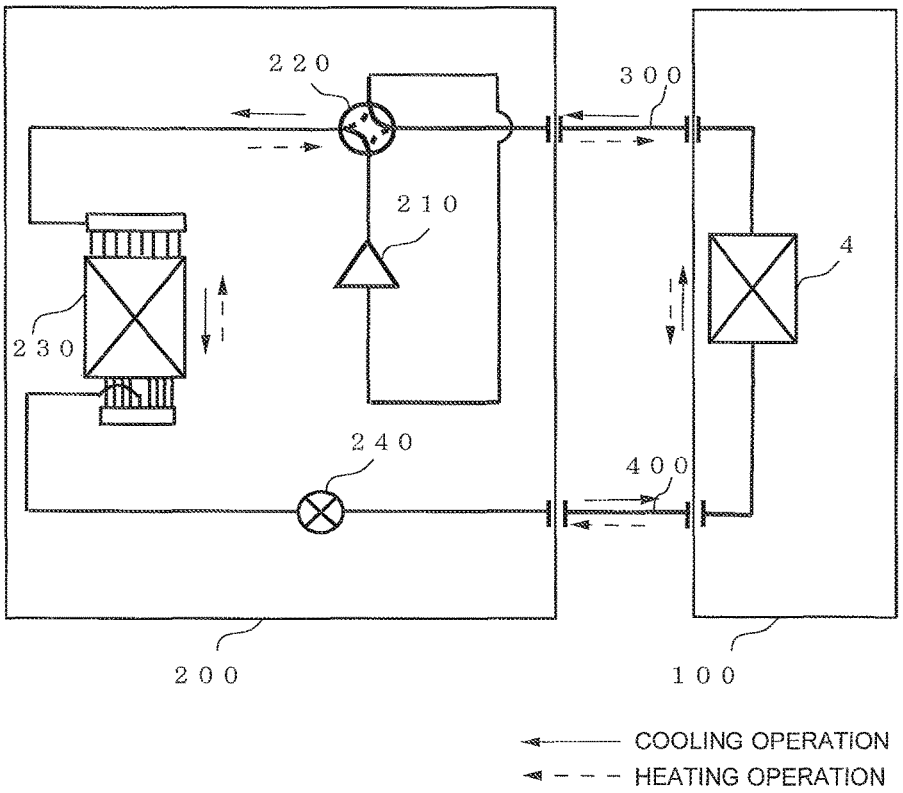
FIG. 23 illustrates an example configuration of an air-conditioning apparatus according to Embodiment 6 of the present invention.

FIG. 23 illustrates an example configuration of an air-conditioning apparatus according to Embodiment 6 of the present invention. FIG. 23 shows the air-conditioning apparatus as an example of a refrigeration cycle apparatus. In FIG. 23, components already described with reference to FIG. 2, for example, perform the similar operations. In the air-conditioning apparatus illustrated in FIG. 23, an outdoor unit 200 and the indoor unit 100 described in the Embodiments above are connected to each other by pipes including a gas refrigerant pipe 300 and a liquid refrigerant pipe 400. The outdoor unit 200 includes a compressor 210, a four-way valve 220, an outdoor heat exchanger 230, and an expansion valve 240.

The compressor 210 compresses sucked refrigerant and discharges the compressed refrigerant. The compressor 210 may change the capacity (the amount of refrigerant that is send in a unit time) by, but not limited to, optionally changing the operating frequency with, for example, an inverter circuit. The four-way valve 220 is a valve that switches a refrigerant flow between a cooling operation and a heating operation, for example.

The outdoor heat exchanger 230 of Embodiment 6 exchanges heat between the refrigerant and air (outdoor air). For example, in the heating operation, the outdoor heat exchanger 230 serves as an evaporator and causes refrigerant to evaporate and vaporize. In the cooling operation, the outdoor heat exchanger 230 serves as a condenser and condenses and liquefies the refrigerant.

The expansion valve 240 such as an expansion device (a flow rate controlling means) reduces the pressure of refrigerant and causes the refrigerant to expand. For example, in a case where the expansion valve 240 is an electronic expansion valve, for example, the expansion valve 240 adjusts the opening degree on the basis of an instruction from, for example, a controller (not shown). An indoor heat exchanger 4 exchanges heat between air to be conditioned and refrigerant, for example. The indoor heat exchanger 110 serves as a condenser and condenses and liquefies refrigerant in the heating operation. The indoor heat exchanger 110 serves as an evaporator and causes refrigerant to evaporate and vaporize in the cooling operation.

As described above, since the air-conditioning apparatus can be configured by using indoor unit 100 described in Embodiments above (i.e., the temperature of the installation wall can be directly detected), the temperature detection range in a room to be an air-conditioned space can be expanded, thereby providing a heating operation and a cooling operation with comfort while achieving energy saving.

REFERENCE SIGNS LIST

1: body, 2: front panel, 3: air inlet, 4: indoor heat exchanger, 4*a*: heat exchanger front portion, 4*b*: heat exchanger upper front portion, 4*c*: heat exchanger upper rear portion, 5: fan, 6: air passage, 7: air outlet, 8: drain pan, 8*a*: upper surface, 8*b*: lower surface, 9: vertical air deflector, 9*a*: front vertical air deflector, 9*b*: rear vertical air deflector, 10: lateral air deflector, 10L: left lateral air deflector group, 10R: right lateral air deflector group, 10*a* to 10*n*: lateral air deflector, 20L: left connecting rod, 20R: right connecting rod, 30L: left drive means, 40: notification device, 60: intake air temperature condition detector, 61: temperature sensor, 62: humidity sensor, 70: controller, 100: indoor unit, 200: outdoor unit, 210: compressor, 220: four-way valve, 230: outdoor heat exchanger, 240: expansion valve, 300: gas refrigerant pipe, 400: liquid refrigerant pipe, 800: temperature sensor, 801: motor, 802: transmission part cover, 803: power transmission part, 804: temperature detector, 805: protective cover, 806: attachment part, 807: rib, 808: stopper, 7*v*: air outlet thermal image, 9*v*: vertical air deflector thermal image, 100*v*: indoor unit thermal image.

The invention claimed is:

1. An indoor unit of an air-conditioning apparatus, the indoor unit having a body placed on a wall surface of a room that is an air-conditioned space, the indoor unit comprising:

a temperature sensor disposed at a position projecting from the body, and including a temperature detector configured to detect a temperature based on heat radiation from a target and a driver configured to cause the temperature detector to rotate, the position being a place where the temperature sensor is capable of detecting a temperature in all the horizontal directions by rotating the temperature detector;

an airflow direction adjustment device configured to adjust a direction in which air that has passed through the body is blown;

an air temperature condition detector configured to detect temperature and humidity of air in the room; and a controller configured to capture a thermal image with the temperature sensor, wherein the thermal image includes a thermal image of the airflow direction adjustment device;

determine the airflow direction adjustment device as being the target based on the thermal image, and determine a state of dew condensation on the airflow direction adjustment device based on the temperature of the airflow direction adjustment device and the temperature and humidity of air in the room.

2. The indoor unit of the air-conditioning apparatus of claim 1, wherein the temperature sensor further includes a stopper that defines a detection start location and a detection end location of the temperature detector.

3. The indoor unit of the air-conditioning apparatus of claim 1, wherein the controller is configured to determine, as being the target, a wall on which the body is placed based on the temperature detected by the temperature sensor.

4. The indoor unit of the air-conditioning apparatus of claim 3, wherein the controller calculates an amount of heat to be supplied to the room including a temperature at a location determined as the wall on which the body is placed, and based on the calculated amount of heat, performs air-conditioning control.

5. The indoor unit of the air-conditioning apparatus of claim 3, wherein the controller derives a sensible temperature in the room based on the temperature at the location determined as the wall on which the body is placed.

6. The indoor unit of the air-conditioning apparatus of claim 1, wherein the controller is configured to determine a window as being the target based on the temperature detected by the temperature sensor.

7. The indoor unit of the air-conditioning apparatus of claim 1, wherein the controller is configured to determine, as being the target, an entrance of the room based on the temperature detected by the temperature sensor.

8. The indoor unit of the air-conditioning apparatus of claim 7, wherein the controller determines an opening condition of the entrance based on a temperature at a location determined as the entrance.

9. The indoor unit of the air-conditioning apparatus of claim 7, wherein if a temperature difference between a temperature at a location determined as the entrance and a temperature in the room is greater than or equal to a predetermined temperature difference, the controller increases or decreases an output of the indoor unit.

10. The indoor unit of the air-conditioning apparatus of claim 1, wherein the controller is configured to determine, as being the target, the wall on which the body is placed, walls adjacent to the wall on which the body is placed, and a floor based on the temperature detected by the temperature sensor to derive a distance from a location at which the body is placed to the walls adjacent to the wall on which the body is placed and a height of the location at which the body is placed from the floor.

11. The indoor unit of the air-conditioning apparatus of claim 10, wherein the airflow direction adjustment device is configured to adjust a direction in which air that has passed through the body is blown, wherein the airflow direction adjustment device is controlled such that air is not blown to a location where no person is present.

12. An air-conditioning apparatus for performing air-conditioning, comprising:

the indoor unit of claim 1; and an outdoor unit.

* * * * *